US009167917B2

(12) United States Patent
Taylor

(10) Patent No.: US 9,167,917 B2
(45) Date of Patent: Oct. 27, 2015

(54) ADJUSTABLE DISPLAY APPARATUS

(75) Inventor: Stephen Dennis Taylor, Neutral Bay (AU)

(73) Assignee: Plastics Tooling and Marketing Pty Ltd., Artarmom, New South Wales (AU)

( * ) Notice: Subject to any disclaimer, the term of this patent is extended or adjusted under 35 U.S.C. 154(b) by 0 days.

(21) Appl. No.: 13/988,751

(22) PCT Filed: Nov. 21, 2011

(86) PCT No.: PCT/AU2011/001499

§ 371 (c)(1),
(2), (4) Date: Aug. 2, 2013

(87) PCT Pub. No.: WO2012/068616

PCT Pub. Date: May 31, 2012

(65) Prior Publication Data

US 2014/0007472 A1 Jan. 9, 2014

(30) Foreign Application Priority Data

Nov. 22, 2010 (AU) ..... 2010905184
Dec. 23, 2010 (AU) ..... 2010905642

(51) Int. Cl.
*B42F 17/08* (2006.01)
*A47F 5/10* (2006.01)
*A47F 7/14* (2006.01)

(52) U.S. Cl.
CPC . *A47F 5/10* (2013.01); *A47F 7/147* (2013.01); *A47F 7/145* (2013.01)

(58) Field of Classification Search
CPC ..... B42F 17/08
USPC ..... 40/124.2, 124.4, 730; 211/52, 55, 211/126.13, 128.1
See application file for complete search history.

(56) References Cited

U.S. PATENT DOCUMENTS 1,156,401 A * 10/1915 Hawley ..... 40/124.2
1,211,065 A * 1/1917 Brady ..... 211/45
1,713,147 A * 5/1929 Ruze ..... 211/50
2,785,487 A * 3/1957 Hopp ..... 40/651
3,880,396 A * 4/1975 Freiberger et al. ..... 248/475.1
4,062,452 A * 12/1977 Bartholomew ..... 211/55
4,079,841 A * 3/1978 Castel ..... 211/131.1
4,083,456 A * 4/1978 Genn et al. ..... 211/55

(Continued)

FOREIGN PATENT DOCUMENTS

WO 9618330 A1 6/1996
WO 2012068616 A1 11/2011

OTHER PUBLICATIONS

PCT International Search Report, PCT/AU2011/001499 dated Jan. 19, 2012.

*Primary Examiner* — Gary Hoge
(74) *Attorney, Agent, or Firm* — TraskBritt, P.C.

(57) ABSTRACT

An adjustable display brochure holder component comprising opposed spaced apart front and rear surfaces, opposed spaced apart first and second side surfaces and a supporting base surface. The rear surface is formed or oriented in a single plane and the rear surface includes a plurality of attachment points therein. Each one of the attachment points is located at or near side edge portions of the rear surface. Each of the attachment points is adapted to engage with a clip, thereby enabling the display brochure holder component to be clipped to, and secured with, an adjacent like display brochure holder component.

14 Claims, 12 Drawing Sheets

(56) References Cited

U.S. PATENT DOCUMENTS

| | | | | | |
|---|---|---|---|---|---|
| 5,056,748 | A * | 10/1991 | Meyer | 248/316.7 |
| 5,085,328 | A | 2/1992 | Evenson | |
| 5,222,609 | A | 6/1993 | Eaton | |
| 5,575,396 | A | 11/1996 | Smed | |
| 5,603,415 | A * | 2/1997 | Balnis, Jr. | 211/40 |
| 5,615,781 | A * | 4/1997 | Janssen | 211/50 |
| 5,800,027 | A * | 9/1998 | Dunn | 312/138.1 |
| 6,213,313 | B1 * | 4/2001 | Levy | 211/51 |
| 6,705,473 | B1 * | 3/2004 | Schlesinger | 211/50 |
| 2008/0099500 | A1 * | 5/2008 | Maier-Hunke | 221/92 |
| 2010/0038330 | A1 * | 2/2010 | Zu | 211/90.04 |

* cited by examiner

ADJUSTABLE DISPLAY APPARATUS

TECHNICAL FIELD

The present invention relates to an adjustable display apparatus, and particularly to an adjustable brochure display having evenly spaced attachment points (keyholes) on each brochure holder pocket that allows adjustable connections to be made between and to the pocket units.

BACKGROUND ART

In conventional brochure display systems, a plurality of brochure holder components are clipped together in a stepped or tiered arrangement to form the display apparatus. A typical conventional brochure display system is shown in FIG. 1.

However, the distance that a conventional brochure display system protrudes or extends from a wall or display stand is limited by the progressive encroachment away from the vertical surface. Accordingly, in practical terms, it is generally not possible for conventional brochure display systems to utilise a large number of rows of the brochure holder components forming the stepped or tiered arrangement.

As such, conventional brochure display systems cannot always be used effectively, particularly where there is either a confined wall space or a confined floor space.

An additional limitation of conventional brochure display systems is their static nature and single configuration characteristics. In general, conventional existing brochure display systems only have one arrangement or configuration of brochure holders—allowing literature to only be displayed on a wall, in a static position on a bench or table top or in a rotatable stand. If a user of such a system wants to change from a wall mounted to a table top or free-standing arrangement they must purchase an alternative display system.

To resolve or substantially alleviate the above problem it would be advantageous to have an adjustable display system comprising a number of components, able to be arranged in a variety of mounting or display configurations. In particular, it would be of advantage to have an adjustable display apparatus or system which incorporates components which could be mounted directly to a wall, mounted to slots or receiving channels formed in the wall, mounted on to a static stand or a rotatable stand or alternatively mounted to an intervening rail connection system connected to a wall.

It would be advantageous to provide an adjustable display apparatus that would overcome at least some of the disadvantages of previously known approaches in this field, or would provide a useful alternative.

DISCLOSURE OF INVENTION

According to one aspect of the invention there is provided an adjustable display brochure holder component comprising:

- opposed spaced apart front and rear surfaces, opposed spaced apart first and second side surfaces and a supporting base surface;
- said rear surface being formed or orientated in a single plane;
- wherein the rear surface includes a plurality of attachment points therein, each one of the attachment points being located at or near side edge portions thereof; and
- each of the attachment points is adapted to engage with a clip, thereby enabling the display brochure holder component to be clipped to, and secured with, an adjacent like display brochure holder component.

According to another aspect of the invention there is provided an adjustable display brochure holder component substantially as described above wherein the rear surface defines the rear extent of the component with no additional elements projecting from the rear surface.

Preferably said rear surface is formed by a flat or level plane without projections and with a plurality of recesses defining attachment points.

According to a further aspect of the invention there is provided an adjustable display brochure holder component substantially as described above wherein the plurality of attachment points comprises a first array located at or near a first side edge portion; a second array located at or near a second side edge portion; and a third array located at or near a base side edge portion.

According to yet another aspect of the invention there is provided an adjustable display brochure holder component substantially as described above wherein the first, second and third arrays extend in a substantially linear direction along the respective first, second and base side edge portions.

According to a further aspect of the invention there is provided an adjustable display brochure holder component substantially as described above wherein each of the plurality of attachment points are keyhole shaped, which are adapted to engage with and secure therein a complementary element of the clip.

According to yet a further aspect of the invention there is provided an adjustable display apparatus comprising:

- one or more display brochure holder components substantially as described above
- at least one clip, which is adapted to engage with each of the plurality of attachment points of the display brochure holder component.

According to another aspect of the invention there is provided an adjustable display apparatus substantially as described above which also includes a floor standing unit adapted to support the display brochure holder components therefrom.

In some embodiments a floor standing unit may define a series of tiered ranks capable of receiving and/or supporting a plurality of display brochure holder components.

In other embodiments a floor standing unit may be capable of rotation relative to a surface supporting the unit.

According to yet another aspect of the invention there is provided an adjustable display apparatus substantially as described above which also includes a mounting rail arranged to mount the rear surface of at least one display brochure holder component to a wall.

Preferably a display brochure holder component may be connected to a mounting rail using at least one intervening clip engaged with at least one attachment point of the display brochure holder.

According to another aspect of the invention there is provided an adjustable display apparatus substantially as described above further comprising at least one angled vertical support clip comprising:

- a first surface that has one or more engagement means, which are adapted to engage with the attachment points at or near the upper edge of the display brochure holder component; and
- a second surface, which is adapted to be secured to a wall surface;

wherein the plane of the first surface is at an acute angle to the plane of the second surface such that when the display brochure holder component is affixed to the first surface, and the second surface is secured to a wall surface, the axis of the display brochure holder component extends at an acute angle from the wall surface.

According to a yet further aspect of the invention there is provided an adjustable display apparatus substantially as described above further comprising at least one vertical connection clip having a substantially flat profile horizontally offset from the main body of the clip, said main body defining at least two engagement means on one surface thereof, wherein the flat profile projects out from the main body of the clip and extends below the main body when the engagement means are connected to a brochure holder.

According to yet another aspect of the invention there is provided an adjustable display apparatus substantially as described above further comprising at least one horizontal connection clip having a substantially flat profile vertically offset from the main body of the clip, said main body defining at least two engagement means on one surface thereof, said flat profile projecting laterally from the main body of the clip.

The present invention is adapted to provide an adjustable display brochure holder component and also preferably additional elements of an adjustable display apparatus capable of receiving, displaying and dispensing literature. These various components of the apparatus allow it to be arranged in a variety of configurations or mounting schemes depending on the requirements of its users. The brochure holder component is preferably the common element of the display apparatus used in all of these configurations—with the remaining components provided to enable the mounting, display or potentially rotation of the brochure holder in various display configurations.

Preferably the rear surface of the brochure holder is formed or orientated in a single plane thereby providing a rear surface without projections. This rear surface will therefore define the maximum rearward extent of the brochure holder and a flat rear surface capable of engaging with a range of further mounting components to be used in a variety of different mounting configurations.

In this specification, unless the context clearly indicates otherwise, the word "comprising" is not intended to have the exclusive meaning of the word such as "consisting only of", but rather has the non-exclusive meaning, in the sense of "including at least". The same applies, with corresponding grammatical changes, to other forms of the word such as

MODES FOR CARRYING OUT THE INVENTION

Figure 1:
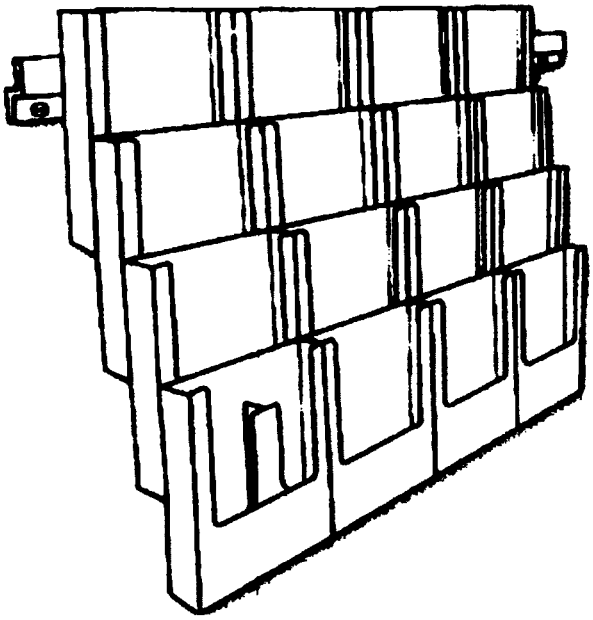
FIG. 1 shows a perspective view of a prior art conventional brochure display apparatus.
Figure 2:
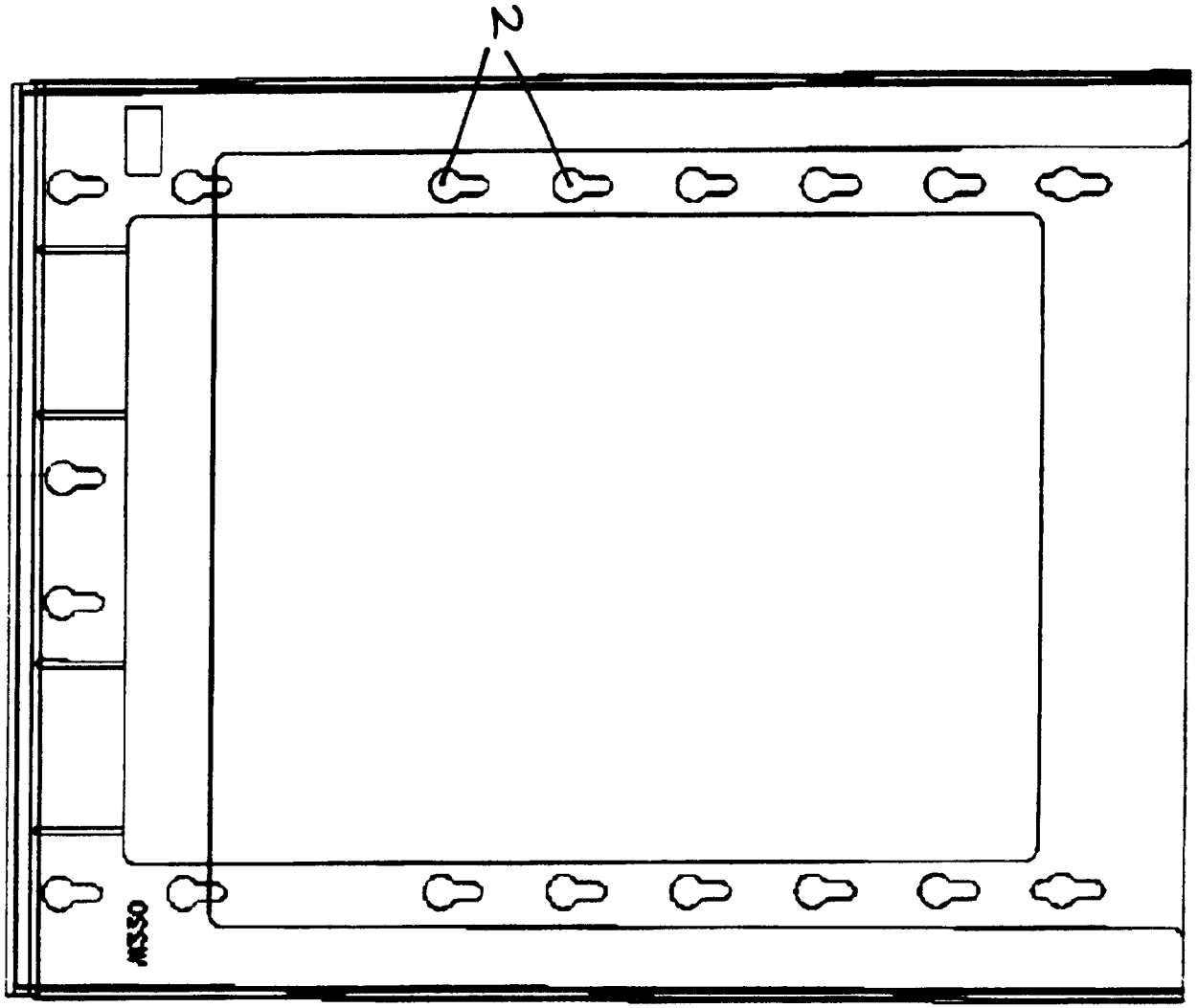
FIG. 2 shows a front plan view of a brochure holder component in accordance with one aspect of the present invention.
Figure 3:
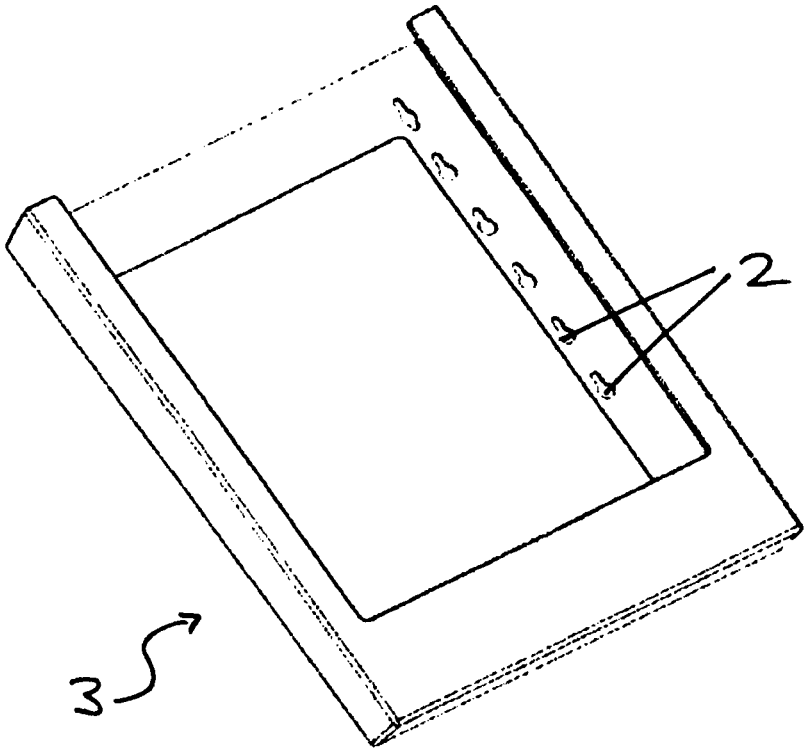
FIG. 3 shows a front perspective view of the brochure holder component shown in FIG. 2.
Figure 4:
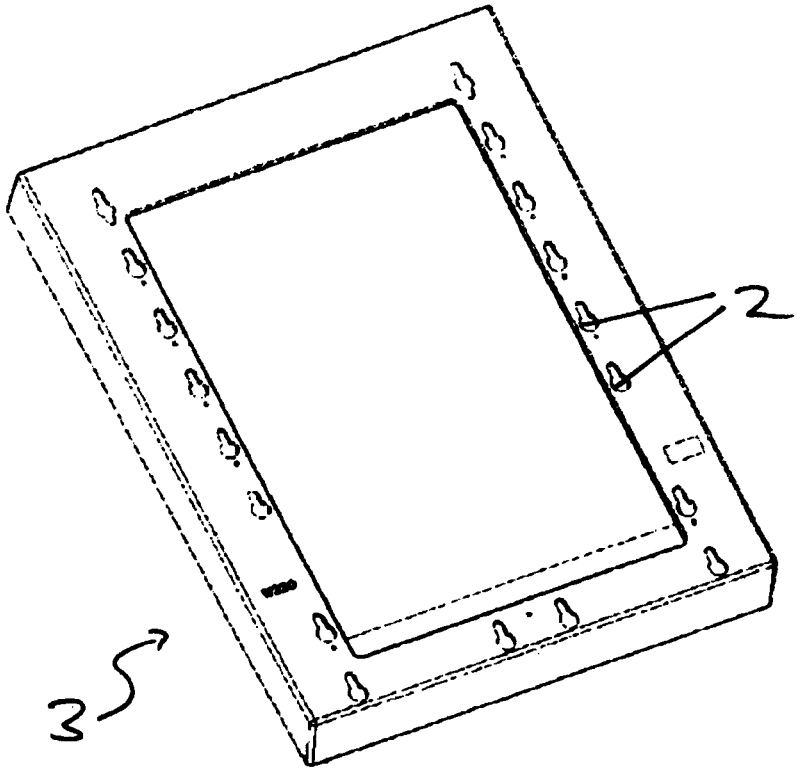
FIG. 4 shows a rear perspective view of the brochure holder component shown in FIG. 2.
Figure 5:
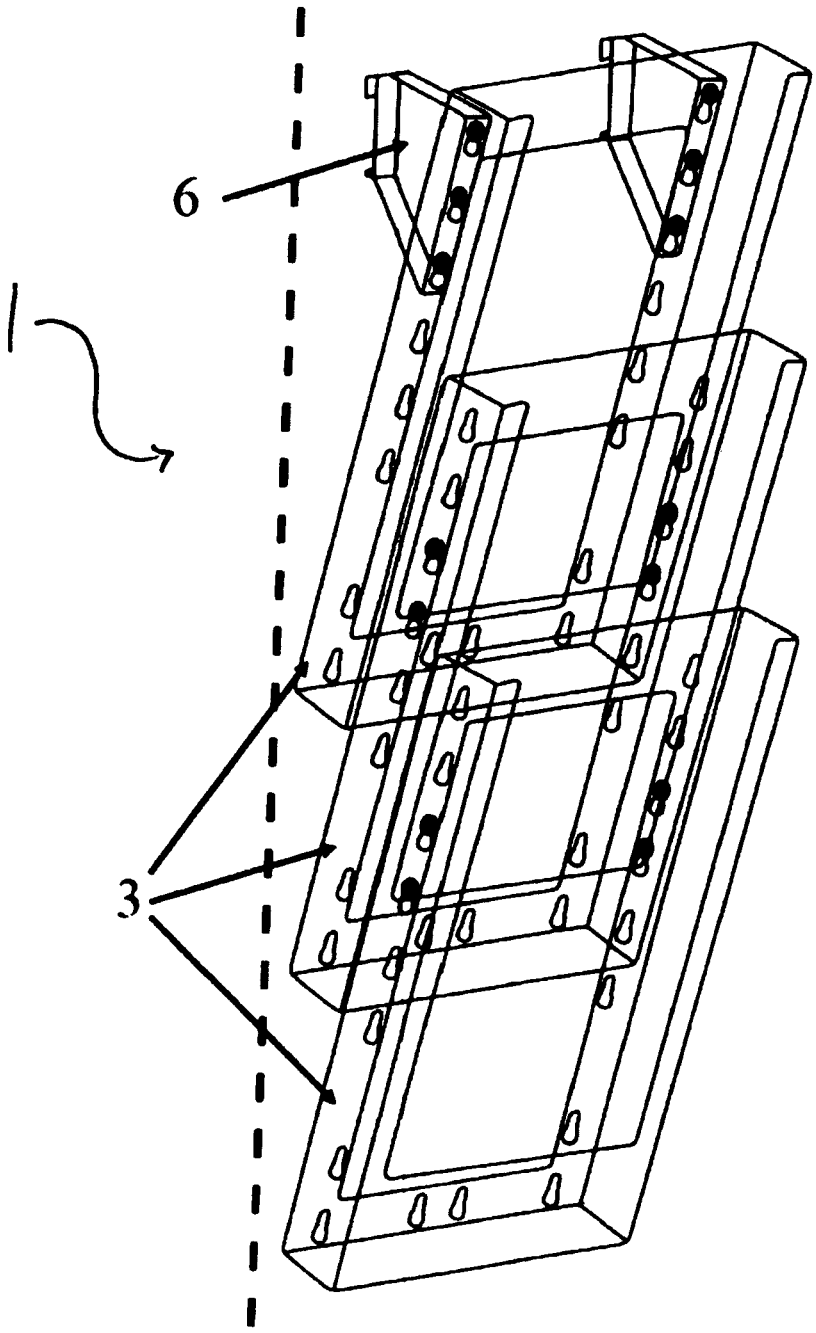
FIG. 5 shows a front perspective view of a plurality of brochure holder components clipped together to form one embodiment of the adjustable display apparatus of the present invention.

In accordance with one embodiment of the present invention, there is provided an adjustable display apparatus (1) having evenly spaced attachment points (keyholes) (2) on each brochure holder (3) that allows adjustable connections to be made between adjacent brochure holder display units.

The array of spaced keyhole attachment points (2) that are located on each of the brochure display units (3) allow for multiple clipping arrangements, which are limited only by the design and shape of the various clips that form part of the adjustable display apparatus of the present invention. A range of different forms of clips provided as part of the invention provide a range of display and mounting options for the brochure display units.

The plurality of attachment points (2) that are located on the rear surface of each of the brochure display units (3) comprises a first array of attachment points that are located at or near a first side edge portion; a second array of attachment points that are located at or near a second side edge portion; and a third array of attachment points that are located at or near a base side edge portion. Furthermore, the first, second and third arrays extend in a substantially linear direction along the respective first, second and base side edge portions.

There are many types of clips that form part of the adjustable display apparatus of the present invention. The main clip type is the brochure display unit connection clip.

The connection clip type can be further defined into a number of specific types of connection clips, each having a particular functionality. For example, there are vertical connection clips (4), side connection clips (5*a* and 5*b*), leaning connection clips (6) and free-standing connection clips (7). Some examples of the different type of clips are shown in use with a brochure holder display unit in FIG. 8.

The side connection clips (5*a* and 5*b*) are used to join and secure two vertically adjacent brochure display units (3) together. The side connection clips have a substantially flat profile (8) offset parallel to the main body of the clip (9), wherein the main body defines at least two engagement means on one surface thereof. The flat profile is arranged to project laterally from the main body of the clip.

Figure 8:
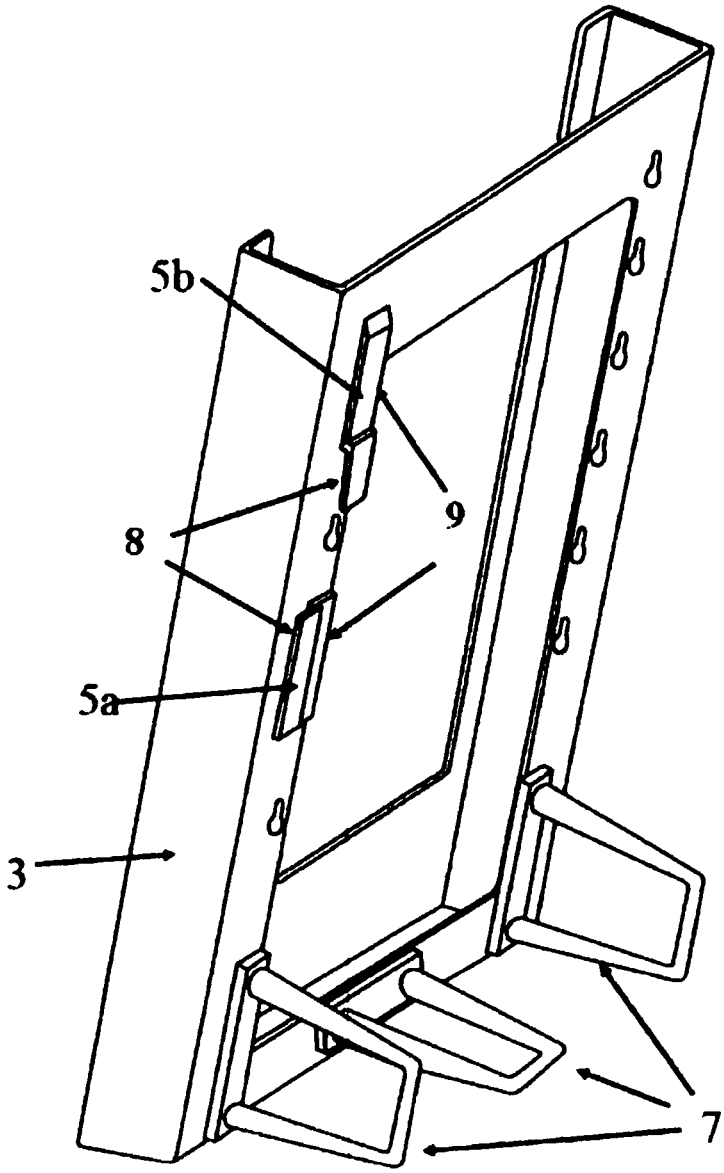
FIG. 8 shows a side perspective view of a brochure holder engaged with two variants of side connection clip and free-standing mounting bracket clips as provided in accordance with a further embodiment of the invention.

FIG. 8 illustrates two different forms of side connection clip (5*a* and 5*b*). The side connection clips shown are configured so that a flat profile (8) projects out slightly from the main body of the clip (9) and extends either horizontally (5*a*) or vertically (5*b*) from the main body.

To join and secure two adjacent brochure display units (3) together, both connection clip engagement means are inserted into keyhole shaped attachment points (2) on both side edges of the first or lower display unit. The projecting flat profile (8) is then slid over the inside of the front face of the upper display unit, thereby hanging the lower base unit from the upper adjacent brochure display unit. The horizontal clip (5*a*) is configured to connect with the vertical vertices of the aperture within the front face of the brochure holder, providing an optimum connection arrangement for identically sized brochure holder units, whereas the vertical clip (5*b*) is configured to connect with the horizontal vertices of the aperture, providing a connection arrangement which may be used to connect between different sized holder units.

In particular, the arrangement of side connection clip (5*a*) provides a more secure attachment of one brochure holder component to a respective brochure holder component than was previously known, as to disengage the respective brochure holder components from each other, one of the brochure holder components must be slid along the full length of the respective brochure holder component before it will disengage.

Similarly, support clips can also be further defined into a number of specific types of connection clips, each having a particular functionality. For example, there are horizontally projecting (4) and angled (leaning) vertical support clips (6) (shown with respect to FIGS. 5-7, 10*a*, 10*b* and 11) and free-standing mounting bracket clips (7 & 10) (shown in use with respect to FIG. 8 and FIG. 12).

The angled vertical support clips (6) can be used to mount the adjustable display apparatus (1) to a wall surface or hang the adjustable display apparatus from a floor standing carousel. Each of the angled vertical support clips includes a first surface (11) that has one or more engagement means (12), which are adapted to engage with the keyhole shaped attachment points (2) at or near the upper edge of a display brochure holder unit (3). The angled vertical support clips also include a second surface (13), which is adapted to be secured to a wall surface or wall mounting strip.

Figure 6:
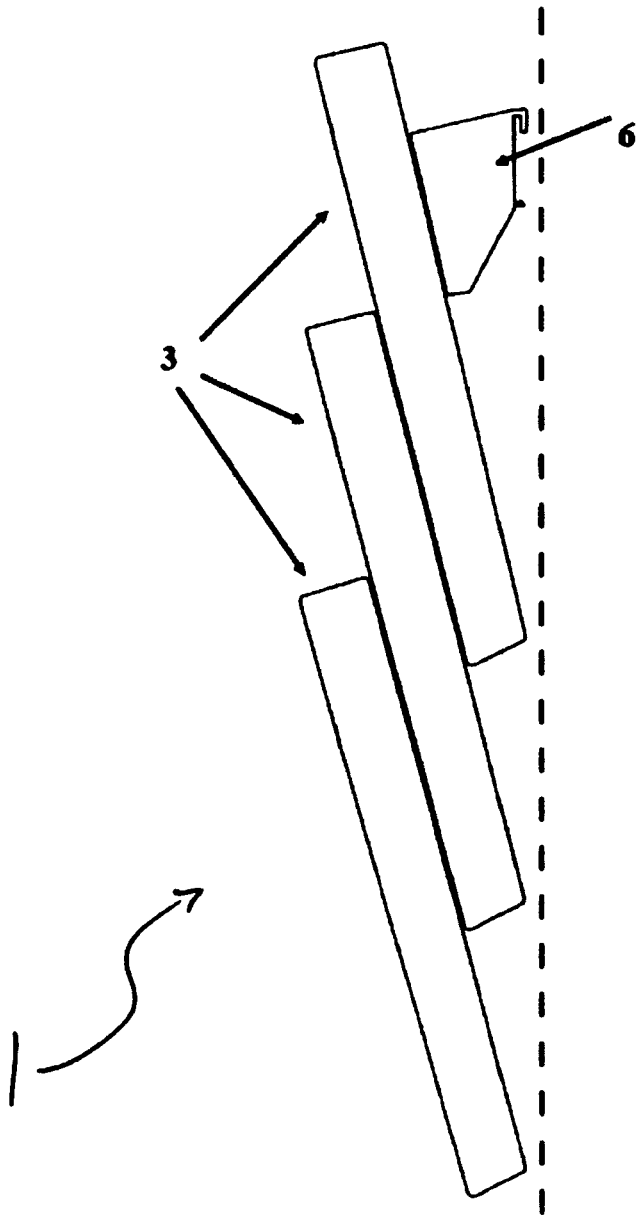
FIG. 6 shows a side plan view of the adjustable display apparatus shown in FIG. 5.
Figure 7:
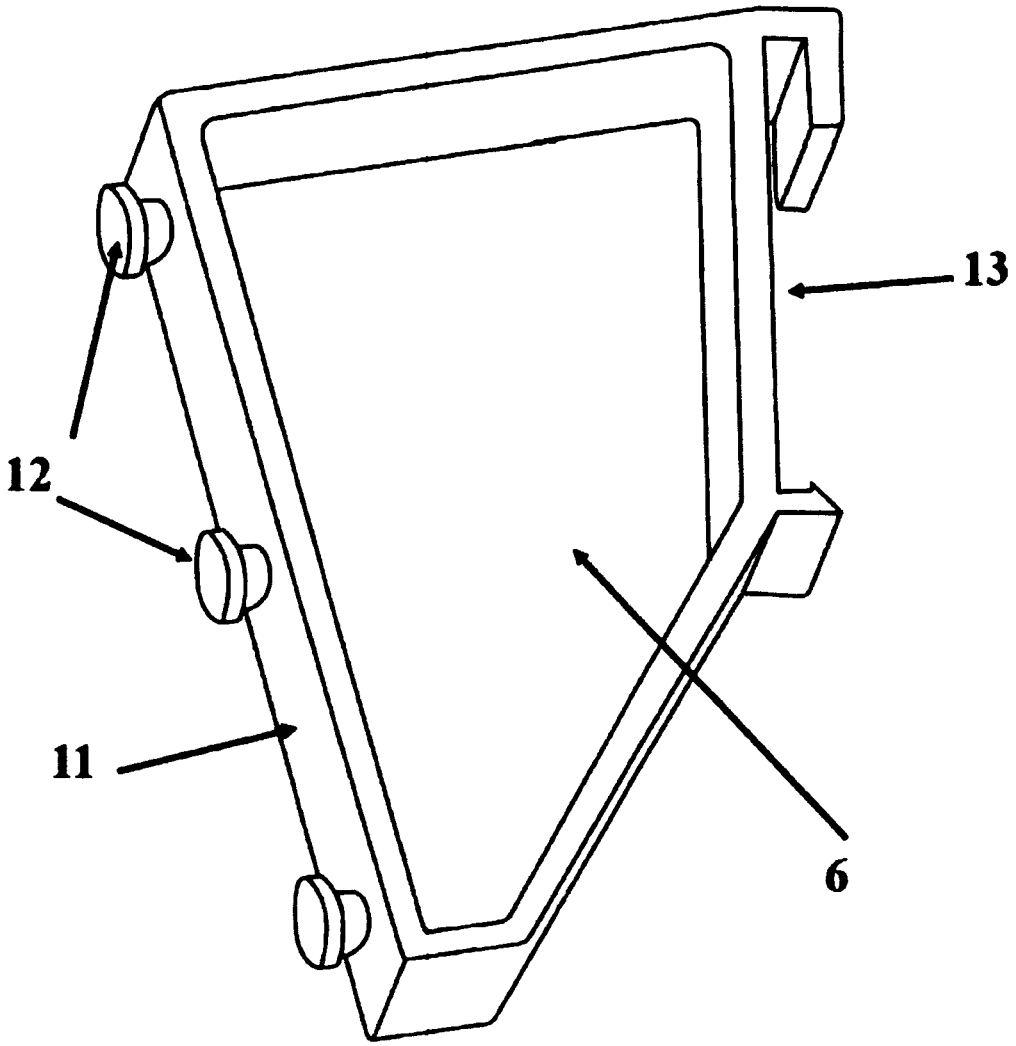
FIG. 7 shows an enlarged perspective view of the angled vertical support clip, according to one aspect of the adjustable display apparatus shown in FIGS. 5 and 6.

The plane of the first surface (11) of the angled vertical support clips is at an acute angle to the plane of the second surface (13). In this way, when the brochure display unit (3) is affixed to the first surface of the angled vertical support clip, and the second surface of the angled vertical support clip is secured to a wall surface, the axis of the brochure display unit extends at an acute angle from the wall surface. This arrangement is best shown in FIG. 6.

The free-standing mounting bracket clips (10) are used to allow one or more of the brochure display units to be placed on a horizontal surface, such as a counter or table top, to be used as an upright or leaning brochure display. Each of the free-standing mounting bracket clips includes a first region (14) that has one or more engagement means (15) thereon, which are adapted to engage with the keyhole shaped attachment points at or near the lower edge of a display brochure holder unit.

The free-standing mounting bracket clips also include a horizontal support surface (16), which is adapted to be supported by the horizontal surface of the counter or table top, thereby allowing the brochure display units to be placed on a horizontal surface, such as a counter or table top, to be used as an upright or leaning brochure display.

Figure 9:
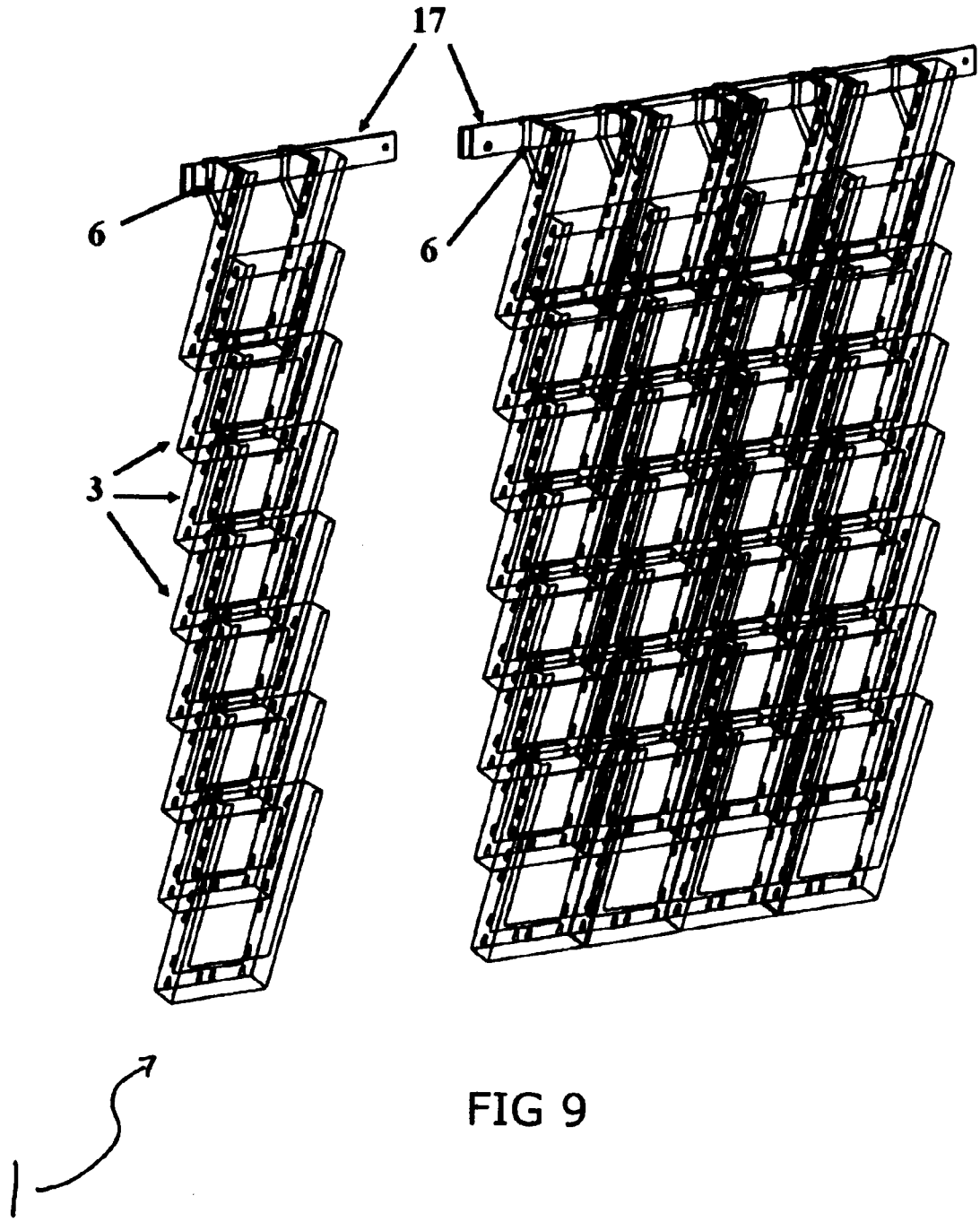
FIG. 9 shows a pair of views of an adjustable display apparatus provided in accordance with a further embodiment which is wall mounted in leaning configuration using an intervening connection rail.

A comparison between the prior art shown in respect of FIG. 1 and the embodiment of the invention illustrated with respect to FIG. 9 clearly shows the arrangement and operation of angled or leaning vertical support clips (6) connected to an intervening mounting rail (17) fixed to a wall. As can be seen from FIG. 9 these angled vertical support clips allow the entire assembled display apparatus to lie substantially parallel with the surface of a wall as compared with the prior art shown in respect of FIG. 1.

The intervening mounting rail (17) provides a user with a range of potential sizes and dimensions for any adjustable display apparatus they may wish to assemble. For example, a large number of brochure holders may be arrayed along the entire length of the rail and down underneath this rail. Alternatively only a single descending rack of brochure holders may be mounted to a wall—or any other arrangement between these two potential arrangements.

Figure 10A:
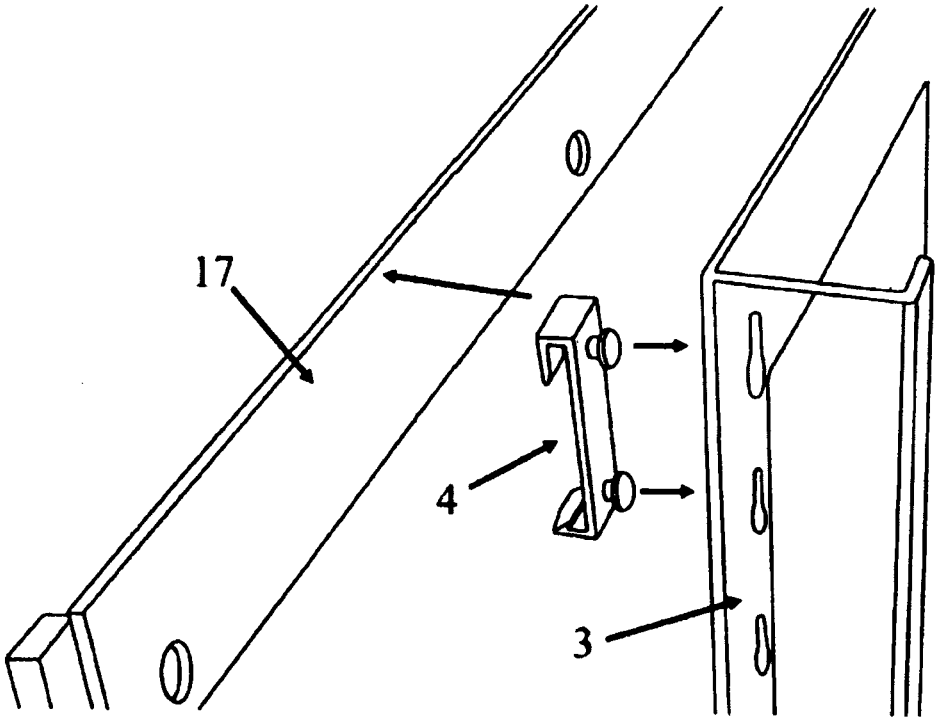
FIGS. 10*a* and 10*b* show two different forms of connection clip employed in accordance with embodiments of the invention to connect a brochure holder to an intervening wall mounting rail.
Figure 10B:
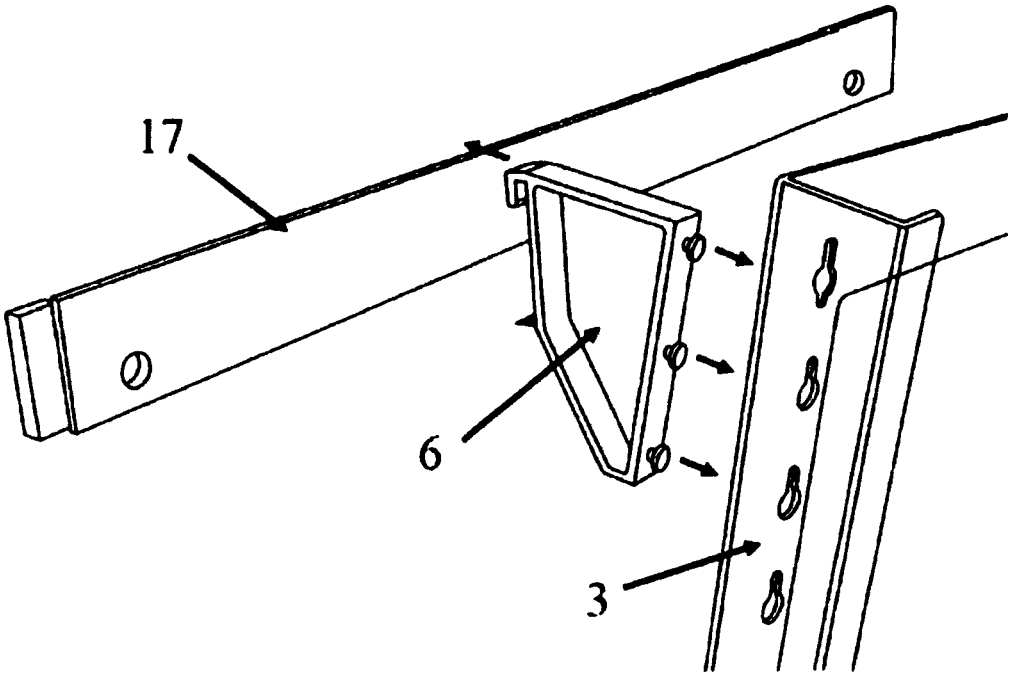

FIGS. 10*a* and 10*b* illustrate two different forms of connection clip provided in accordance with one embodiment of the invention to connect a brochure holder to an intervening wall mounting rail.

In particular FIGS. 10*a* and 10*b* show two different forms of vertical support clip, with FIG. 10*a* illustrating a vertical connection clip having a substantially flat profile (4) while the clip of FIG. 10*b* provides an angled leaning vertical support clip (6).

FIGS. 10*a* and 10*b* illustrate the connection scheme employed in respect of these two forms of vertical support clip to engage each clip with an intervening mounting rail (17) and a rear surface of the brochure holder (3).

Figure 11A:
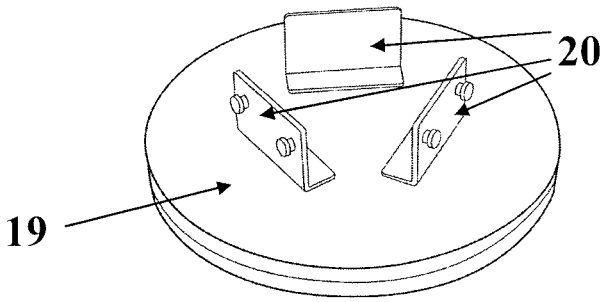
FIG. 11 shows a range of views illustrating the assembly of a rotatable free standing display stand employed in accordance with a yet further embodiment of the invention.
Figure 11B:
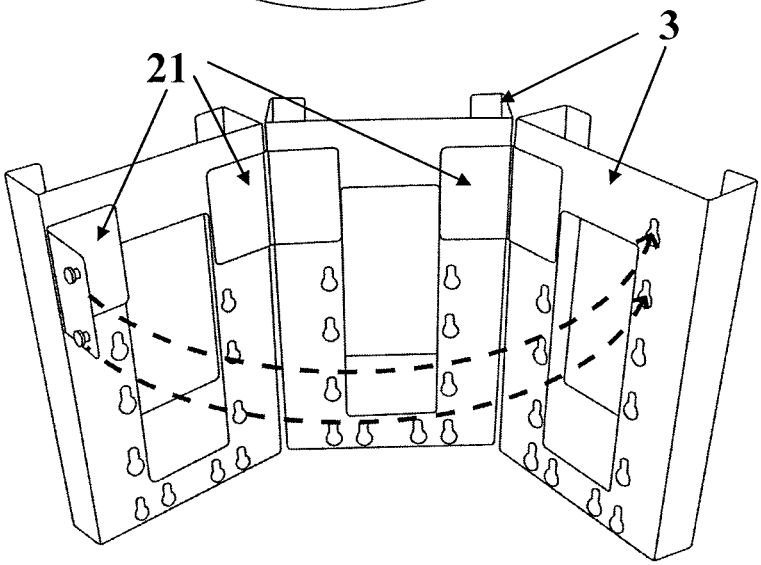
Figure 11C:
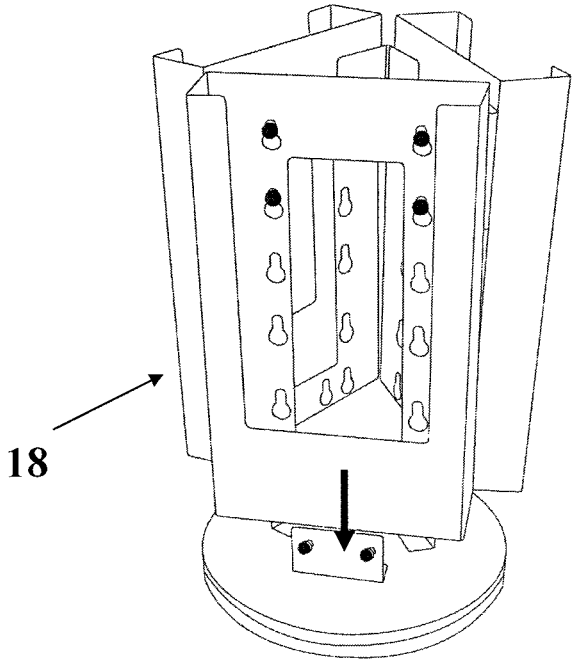

FIG. 11 shows a range of views illustrating the assembly of a rotatable free-standing display (18) provided in accordance with a further embodiment.

In particular, the sequential set of views provided with respect to FIG. 11 show the assembly of a table standing rotatable display apparatus including a rotating turntable base (19) and a series of vertical and horizontal connection clips used to connect and secure three brochure holder components (3) to the assembled stand.

Initially a set of three vertical support clips (20) are connected to the top surface of the rotatable base as shown. Concurrently three pivoting or hinged horizontal side connection clips (21) are employed to connect together the three brochure holder components (3) at their adjacent sides or edges. These horizontal side connection clips are used to form a substantially triangular assembly of connected brochure holders as illustrated with respect to FIG. 11.

Lastly the connected triangular brochure holder assembly is pushed down onto and into engagement with the vertical support clips previously fixed to the upper surface of the rotatable display stand.

Figure 12A:
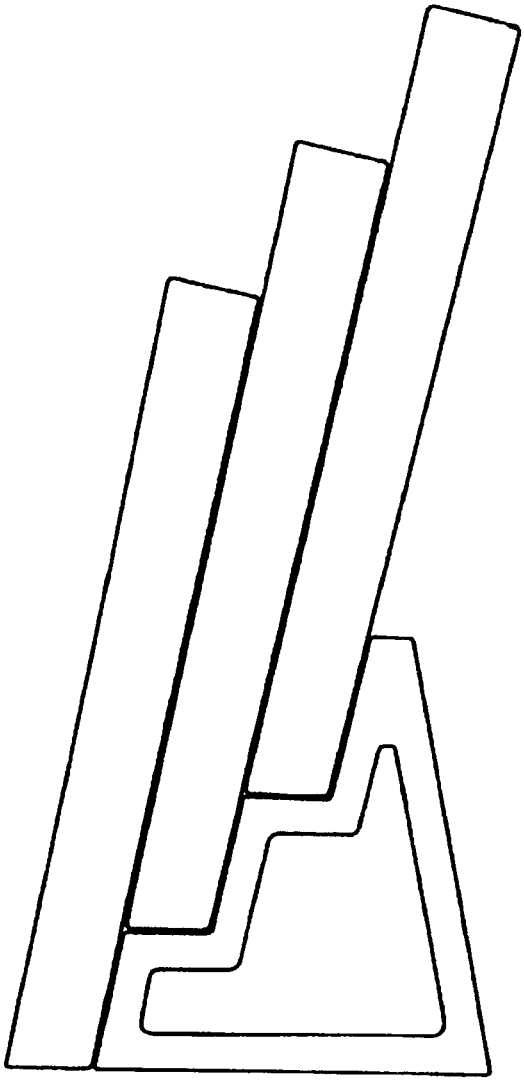
FIG. 12 shows a yet further embodiment of the invention where a table top arrangement of adjustable display apparatus is provided with the use of a pair of clip based brackets defining a series of tiered ranks.
Figure 12B:
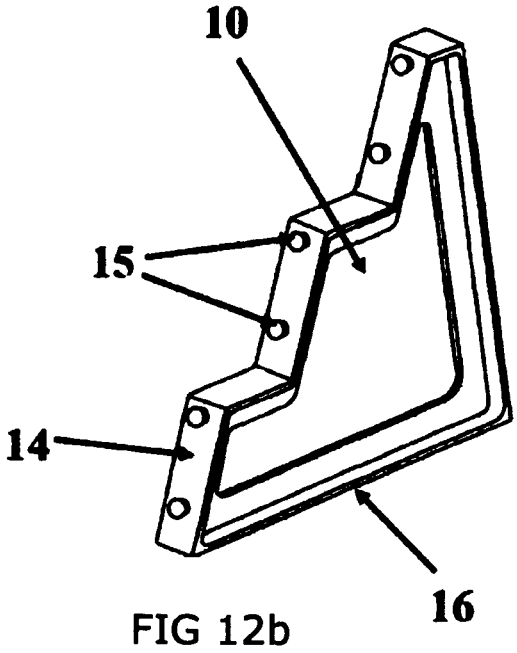

FIG. 12 shows a yet further embodiment of the invention where a table top arrangement of adjustable display apparatus is provided through the use of a pair of clips brackets (10) defining a series of tiered ranks.

In the embodiment shown with respect to FIG. 12 the flat rear surfaces of each brochure holder component allow for the tiered stacking of these components together while the base or bottoms of this tiered assembly is supported by a pair of tiered or stepped free standing bracket clips.

As outlined above, the arrangement of the spaced keyholes (2) on each brochure holder (3) allows for adjustable connections to be made between and to the brochure holder display units.

A further advantage of the spaced keyhole shaped attachment points of the brochure display units is that the arrays of attachment points allow for the clipped together brochure holder display units, which are clipped together in such a way as to cascade down a wall surface (i.e. in a tiered configuration), to be compressed together in a tighter fashion as compared to conventional brochure display systems. This allows more brochure display units to be utilised within the adjustable brochure display apparatus of the present invention and thus allows for more brochure display units to be mounted within a predefined space on walls or to hang from a floor standing carousel.

The adjustable display apparatus of the present invention allows for an unlimited number of brochure holder display units to be clipped together and arranged cascading down against a vertical surface, such as a wall surface, without increasing the distance that the display apparatus protrudes or extends from the vertical surface. This is achieved through the use of an angled vertical support dip (6) that forms part of the adjustable display apparatus of the present invention.

The arrangement of the spaced keyhole attachment points (2) on each of the brochure holder display units (3) also allows the brochure holder display units to be clipped together with a relatively large space between vertically adjoining units, thereby providing maximum exposure of literature within a predefined space on walls or hanging from floor mounted carousels.

The modular components of the adjustable display apparatus of the present invention allows for particular individual components to be replaced without the need to replace the entire unit/system.

The clips that attach the brochure holders together in a tiered structure and form part of the apparatus of the present invention are simple to use. The clips are adapted to simply slide into desired keyholes on each respective brochure holder.

The brochure holders are adapted for multi purpose applications. For example, in one embodiment of the present invention, the apparatus includes a floor standing display unit, which includes a mounting base that is hexagonal in shape and allows six to eighteen brochure holder components on a single level of the floor standing display unit.

In another embodiment, the apparatus includes specially designed clips that are adapted to be mounted on the top rail of car windows and other similar applications.

A significant advantage of the present invention over conventional brochure display systems is the ability to adjust the brochure holder components in a simple manner to configure both wall systems and variants of floor mounted carousel systems in either compressed tiered configurations or expanded tiered configurations.

Another advantage of the present invention is the flexibility to convert the adjustable display apparatus from one format easily to another (e.g. from tiered carousel to a wall display system to a countertop display).

INDUSTRIAL APPLICABILITY

The present invention can be used in relation to brochure displays, magazines and the like, particularly where there is only limited predefined space on walls or limited hanging space from floor mounted carousels.

The adjustable display apparatus of the present invention has a broad appeal throughout the entire business sector, retail environment as well as private sector, particularly where there is a requirement to display marketing material and/or brochures.

The invention claimed is:

1. An apparatus for displaying brochures, the apparatus comprising:

two like brochure holder components, each brochure holder component comprising:

opposed spaced apart front and rear surfaces, opposed spaced apart first and second side surfaces and a supporting base surface;

the front surface having an aperture therein defining opposed parallel side edges; and the rear surface having a plurality of attachment points configured to releasably engage with a clip;

two like clips, each clip comprising:

an engaging portion configured to engage with at least one attachment point; and a receiving portion configured to receive at least one of the side edges;

wherein, in use, the engaging portion of each clip engages at least one attachment point of a first brochure holder component and the receiving portion of each clip slidably engages one of the side edges of a second brochure holder component, thereby releasably securing the first brochure holder component to the second brochure holder component;

at least one angled clip, each angled clip comprising:

a first surface having an engaging portion configured to engage with at least one attachment point; and a second surface, arranged at an acute angle to the first surface and adapted to be secured to a wall;

wherein, in use, the second surface is secured to the wall and the engaging portion of the first surface engages at least one attachment point of the second brochure holder component, thereby suspending the first brochure holder component and the second brochure holder component to the wall; and a rail adapted to be secured to the wall, wherein the second surface is adapted to receive the rail, thereby securing the angled clip to the wall.

2. The apparatus of claim 1, wherein, in use, the receiving portion of a first clip slidably engages one of the side edges, and the receiving portion of a second clip slidably engages the opposite side edge.

3. The apparatus of claim 2, wherein the aperture further defines a base edge and wherein, in use, the receiving portion of each clip abuts the base edge.

4. The apparatus of claim 1, wherein the brochure holder component has a notional line of symmetry between the side surfaces, and wherein the plurality of attachment points include at least one attachment point arranged either side of the notional line of symmetry.

5. The apparatus of claim 4, wherein the plurality of attachment points are spaced apart from the side surfaces and the side edges towards the notional line of symmetry.

6. The apparatus of claim 4, wherein the plurality of attachment points comprise a first array located proximal to one of the side surfaces, a second array located proximal to the opposite side surface, and a third array located proximal to the base surface.

7. The apparatus of claim 6, wherein the first, second and third arrays extend in a substantially linear direction.

8. The apparatus of claim 1, wherein the clip comprises a body having the engaging portion arranged thereon, and the receiving portion comprises an arm extending from the body.

9. The apparatus of claim 8, wherein the engaging portion comprises at least one projection.

10. The apparatus of claim 9, wherein each of the plurality of attachment points comprises an aperture dimensioned to receive and retain one of the at least one projection.

11. The apparatus of claim 10, wherein each of the plurality of attachment points comprises a keyhole shaped aperture.

12. The apparatus of claim 1, wherein the receiving portion comprises a substantially flat profile that extends horizontally from a main body of the clip.

13. The apparatus of claim 1, further comprising at least another clip including:

another engaging portion configured to engage with at least one attachment point, and another receiving portion comprising a substantially flat profile that extends vertically from a main body of the another clip.

14. The apparatus of claim 1, wherein the side edges defined by the aperture of the front surface are closer to a closest one of the first and second side surfaces than each of the plurality of attachment points.

* * * * *